United States Patent [19]

Heina et al.

[11] Patent Number: 4,928,953

[45] Date of Patent: May 29, 1990

[54] ROTARY SHEET FEEDER

[75] Inventors: Karl-Fritz Heina, Murrhardt; Horst Schwarz; Wolfgang Weber, both of Grosserlach, all of Fed. Rep. of Germany

[73] Assignee: Maschinenbau Oppenweiler Binder GmbH & Co., Fed. Rep. of Germany

[21] Appl. No.: 239,199

[22] Filed: Aug. 31, 1988

[30] Foreign Application Priority Data

Sep. 25, 1987 [DE] Fed. Rep. of Germany ..... 3732419

[51] Int. Cl.[5] ..... B65H 29/00

[52] U.S. Cl. ..... 271/185; 271/216; 271/198

[58] Field of Search ..... 271/69, 306, 184, 185, 271/198, 149, 216

[56] References Cited

U.S. PATENT DOCUMENTS 3,271,026 9/1966 Germen ..... 271/185
4,245,833 1/1981 Akerstrom ..... 271/198

FOREIGN PATENT DOCUMENTS 1015822 9/1957 Fed. Rep. of Germany ..... 271/69
1960543 10/1970 Fed. Rep. of Germany .
48503 3/1983 Japan ..... 271/198

*Primary Examiner*—H. Grant Skaggs
*Attorney, Agent, or Firm*—John F. A. Earley; John F. A. Earley, III; P. Michael Walker

[57] ABSTRACT

In order to avoid a pushing-together or pulling apart of an imbricated stack of sheets during reversal around the reversing roller (3) of a rotary sheet feeder (1), belt-like flexible guide means (18) are used which are disposed at intervals over the axial length of the reversing drum (3), one end of the feeder frame side forming an intake gusset while the other end of each is articulated through a spring (19) on a rod (20) which connects the side walls of the feeder frame (7). The flexible guide means (18) pass between the reversing element (13) and the intake side roller (8) of the second belt conveyor (6) which forms the withdrawal table, the reversing element (13) like the other rollers of the second belt conveyor being mounted on a pivotable frame (11) which is articulated in turn on the feeder frame (7) and is initially tensioned in the direction of the reversing drum (3).

11 Claims, 4 Drawing Sheets

ROTARY SHEET FEEDER

BACKGROUND OF THE INVENTION

The invention relates to a rotary sheet feeder with a feeder frame on which there are disposed an upper feeder table adapted to be loaded with imbricated stacks of sheets and which comprises a first belt conveyor with rollers, a reversing drum, a lower withdrawal table comprising a second belt conveyor with rollers, the receiving side of which is disposed opposite the delivery portion of the first belt conveyor and, disposed at intervals from one another, flexible guide means for pressing the sheets against the reversing drum and adapted to the existing sheet stack height, said guide means having one end supported above the upper feeder table and forming with the reserving drum an intake gusset, while their bottom ends are fixed via elastically extensible elements on respective rods connected to the feeder frame.

In the case of such a rotary sheet feeder which is known from DE-A-1 960 543, the flexible guide means for pressing the sheets against the reversing drum consist on the one hand of belts which revolve endlessly about rollers situated at intervals over the axial length of the reversing drum and of which some are so mounted for elastic deflection that adaptation to whatever is the given height of the imbricated stack of sheets is assured while maintaining the pressure which is applied by the belts. In addition, between these endless guide belts there are provided cable-like guides each of which has one end supported above the upper feeder table, forming an intake gusset together with the reversing drum, while their bottom ends are connected via springs to fixed points on the frame side, so that by stretching these springs the cable-like guides can likewise be adapted to the height of the stack sheet.

In the case of the prior art rotary sheet feeder, the speed of the sheet stack at the table end is somewhat less than that of the guide belts which press the stack of sheets against the reversing drum because the outer end of the stack in contact with the guide belts travels in an arc of greater radius than that of the inner end of the stack which is adjacent the reversing drum. The cable-like guides consist of a low-friction material and therefore do not impede the travel of the outer end of the stack. By reason of this relative speed between the guide belts and the stack, it is possible for the imbricated arrangement to be disturbed, which becomes translated into irregular distances between the sheets at the withdrawal table. The adjustment of an identical speed from time to time in order to reduce the relative speed to zero is very complicated both in terms of apparatus and also with regard to control processes.

It is also known from GB-C-604653 to provide at a distance from the reversing drum of a rotary sheet feeder curved guide members which are mounted on the feeder frame. These guide members have on the one hand quite considerable friction and only permit of adaptation to different heights of sheet stacks after complicated adjustment operations have been performed.

An object of the present invention is to reduce or alleviate the problem of disturbance of the stacks of sheets which arises from the difference in speeds between the radially inner and outer ends of the stacks.

SUMMARY OF THE INVENTION

The invention provides a rotary sheet feeder comprising a feeder frame, an upper feeder table mounted on the feeder frame for carrying imbricated stacks of sheets into the rotary sheet feeder, the upper feeder table comprising a first endless belt conveyor, a reversing drum mounted for rotation about the drum axis and one or more rollers, the first endless belt conveyor being wound around the reversing drum and rollers. A delivery zone is defined below the reversing drum and flexible guide means are disposed about the periphery of the reversing drum for pressing the stacks of sheets against the first endless belt conveyor as it travels around the reversing drum. The upper end of the flexible guide means are supported above the upper feeder table and the flexible guide means are tensioned at their lower ends. A withdrawal table is pivotally mounted on the feeder frame at a pivot axis which is parallel to and spaced apart from the drum axis. The withdrawal table is disposed below the reversing drum and receives in imbricated stacks of sheets from the delivery zone and carries them out of the delivery zone. The withdrawal table comprisese two or more further rollers and a second endless belt conveyor wound around the further rollers, one of the further rollers being located adjacent the delivery zone. The withdrawal table is urged upwardly towards the reversing drum. Further support means are mounted on the withdrawal table adjacent the delivery zone for supporting a portion of the flexible guide means intermediate the upper and lower ends thereof. This portion of the flexible guide means curves away from the reversing drum around the further support means between the above-mentioned one further roller and the further support means.

The flexible guide means enables virtually friction-free guidance of the sheet stack around the reversing drum so that there is no relative speed between the two sides of the sheet stack so that upon a change of direction and at the time of delivery to the withdrawal table, retention of an even and regular imbrication and thus regular intervals between sheets can be guaranteed. Due to the resilient pretension of the pivotable frame in the direction of the reversing drum, for example assured by a gas spring, and by virtue of the resiliently elasting fixing of the bottom end of each of the flexible guide means, automatic adaptation to the height of whatever sheet stack is being fed is assured.

In a preferred embodiment, the flexible guide means are belts which are composed of low-friction synthetic plastics material, such as polytetrafluoroethylene for example. This enables each stack of sheets to be deflected with very little friction.

In a preferred embodiment, the flexible guide means further comprises one or more transfer belts whose lower ends rest on said second endless belt conveyor said delivery zone. This facilitates the transfer of the stacked sheets to the second belt conveyor.

In another preferred embodiment, the flexible guide mans comprises a plurality of guide rollers mounted on elongate flexible supports for rotation about parallel roller axes. The parallel roller axes are spaced apart along the length of the flexible supports and are parallel to the drum axis. In this embodiment, the stacked sheets are pressed against the reversing drum with very low friction. Preferably, the guide rollers have mid-portions of smaller diameter than their end portions and an endless guide belt is accommodated in the mid-portions between said end portions. The guide belt has a thickness which is less than the difference in the diameters of the mid and end portions. Accordingly, the stacked sheets are guided only by the end portions of the rollers and not by the endless guide belt.

By covering over the gap between the rollers in their mid-regions, it is possible to avoid parts of sheets finding their way between the rollers. The inherently very low friction is further reduced by a reduction of the contact area between the rollers and the sheets. Frictional contact between the guide belt and the sheet does not occur.

Preferably the guide means comprises a plurality of flexible guide members spaced apart in the direction of the drum axis, the rotary sheets feeder further comprising lower guide members which extend between the flexible guide members immediately beneath the delivery zone, the lower guide members having free ends to rest on the second endless belt conveyor. Accordingly, guidance of the stacked sheets in the lower zone of the reversing drum is assisted.

Preferably, the rotary sheet feeder further comprises upper guide members which extend downwardly between the flexible guide members and have free lower ends which rest on the lower guide members. This provides an additional low friction guidance of the stacked sheets in the upper portion of the reversing drum.

The upper and/or lower guide members are suitably composed of a resilient material, such as polytetrafluoroethylene, for example.

Preferably, the upper end of the flexible guide means is supported on an elongate member which is pivotally mounted on the feeder frame for rotation about a horizontal axis. The elongate member carries the flexible guide means at a region thereof which is spaced apart from the horizontal axis, and pivoting of the elongate member is limited by upper and lower abutments. The elongate member is biased towards the lower abutment by means of a spring for example. Accordingly, the sheet feeder can accommodate stacks of various heights at the region of the upper feeder table adjacent the reversing drum.

DESCRIPTION OF THE PREFERRED EMBODIMENT

Figure 1:
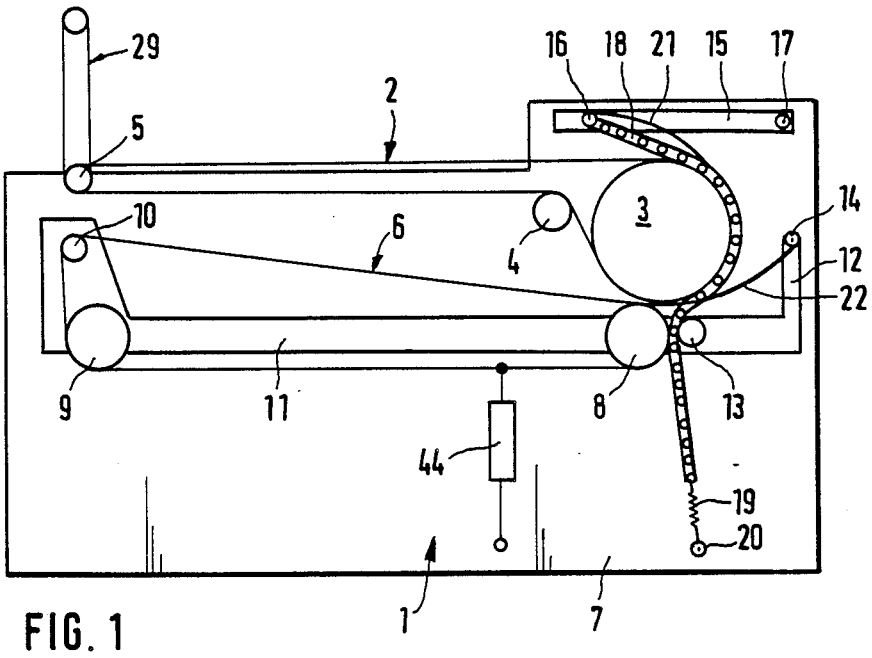
FIG. 1 diagrammatically shows a side view of a rotary sheet feeder without sheet conveyance, a side wall of the feeder frame having been omitted.
Figure 2:
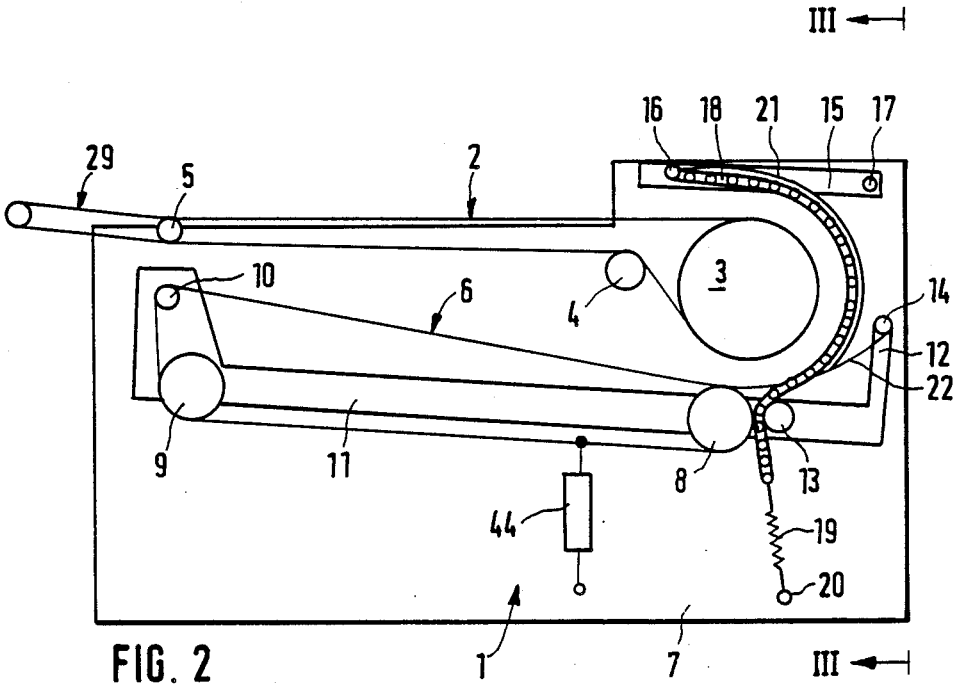
FIG. 2 is a view similar to that in FIG. 1 showing the rotary sheet feeder in a position of delivery of a sheet stack, which is not shown.
Figure 3:
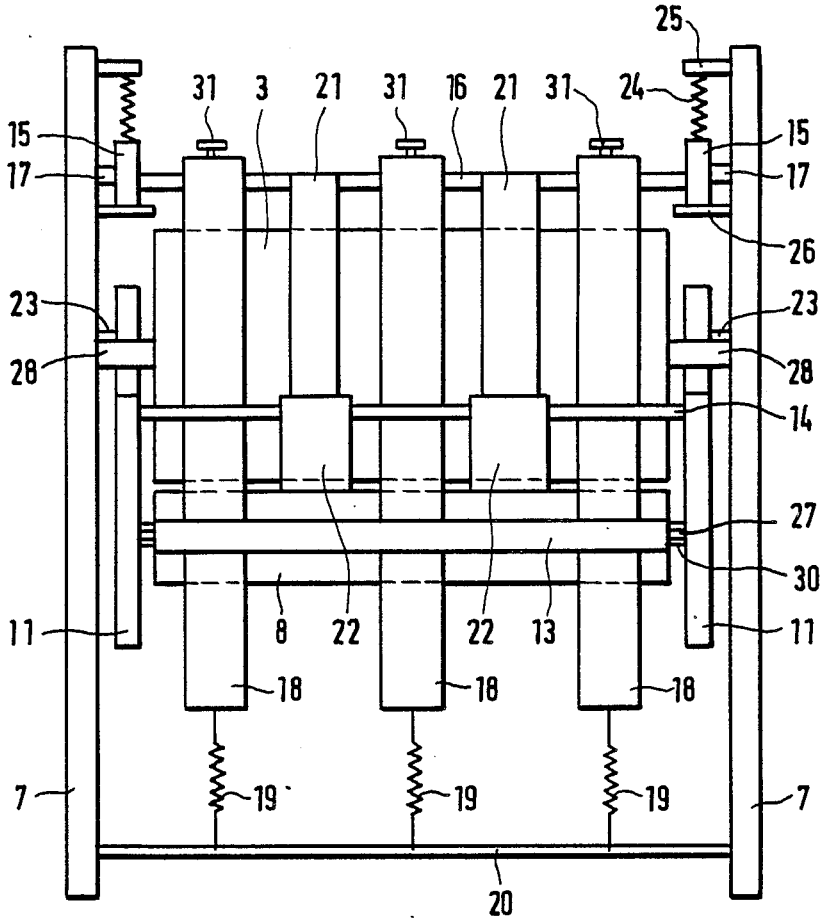
FIG. 3 is the view on the line III—III in FIG. 2.

The rotary sheet feeder 1 shown in FIGS. 1 to 3 comprises a feeder table with a first belt conveyor 2 to which belongs a reversing drum 3 and rollers 4 and 5, as well as a belt drive, not shown. Under the reversing drum 3 there is a withdrawal table with a second belt conveyor 6, the conveyor belt of which is guided over rollers 8, 9 and 10 and is driven by a drive, not shown.

The rollers 8, 9 and 10 are mounted on the side parts of a pivotable frame 11. In the region of the delivery end of the second belt conveyor 6, the side parts are articulated on the side walls of the feeder frame 7 by pivot journals 23 (FIG. 3), and are initially urged in the direction of the reversing drum 3 by a gas spring 44 adjustably engaging the feeder frame 7. The side parts of the pivotable frame 11 have at their end opposite the articulation on the feeder frame 7 an upwardly extending arm 12. The arms 12 of the side parts of the pivotable frame 11 are connected by a rod 14. At a distance from the roller 8 in the direction of the arms 12 there is rigidly or rotatably mounted on the side parts of the pivotable frame 11 a reversing element 13 which may consist of a roller.

By means of a pivot journal 17, there is articulated on each side part of the feeder frame 7 a pivotable lever 15 which in the region of its end opposite the pivot journal 17 carries, connecting the pivot levers 15, a rod 16 on which are articulated belt-like flexible guide means 18 provided with rollers 32 (FIG. 4) and disposed at intervals over the axial length of the reversing drum 3. The flexible guide means 18 form with the feeder table of the first belt conveyor 2 an inlet gusset for a stack of sheets. The other ends of the flexible guide means 18 are connected by springs 19 to a rod 20 extending between the side parts of and in the lower region of the feeder frame 7. The flexible guide means are disposed for displacement between the intake-side roller of the second belt conveyor 6 and the reversing element 13. In the position shown in FIG. 1 in which no sheet stacks is present, the flexible guide means 18 bear on the reversing portion of the periphery of the reversing drum 6, while in the position shown in FIG. 2 for sheet conveyance, they have adapted automatically to a given height of sheet stack by extension of the springs 19. In this position, the pivotable frame 11 is pivoted downwardly according to the height of the sheet stack by compression of the gas spring 44.

As can be seen particularly in FIG. 3, there are additional guides between the flexible guide means 18. Each of these guides has a bottom guide member 22 fixed on the rod 14 which connects the arms 12 and which is disposed at the height of the centre of the reversing drum 3 or somewhat below this. The free end of guide member 22 bears tangentially upon the upper strand of the second belt conveyor 6 which receives the sheet stack. Since the lower guide portions 22 are, by mounting on the pivot frame 11, pivoted in the same way as the second belt conveyor 6 and as a function of the heigh of the sheet stack, there is only minimal displacement of the lower guide members 22 in the region of their end which rests on the second belt conveyor 6, which depends upon the deflection brought about by the given height of the sheet stack, so that the length of the bottom guide portions 22 is short, the friction being therefore kept to the minimum possible.

On the upper rod 16 which connects the pivot levers 15 and on which the flexible guide means 18 are articulated, there are between the flexible guide means 18, in correlation with the bottom guide members 22, upper guide members 21, the free ends of which rest tangentially on the lower guide members 22. In the case of the position shown in FIG. 1, in which no stack of sheets is being conveyed, the upper guide members 21 extend as far as the intake side of the second conveyor belt 6, while in the position shown in FIG. 2, in which a sheet stack, (not shown) is being conveyed, the upper guide members 21 extend into the plane of contact of the flexible guide means 18 with the stack of sheets but are, however, in order to be able to show the path of their progress, shown as being displaced somewhat rightwardly in FIG. 2. The bottom end of the upper guide members 21 has moved thereby on the lower guide members 22, the guide surfaces merging in tangent fashion into the guide surfaces of the lower guide members 22. The upper guide members 21 and the lower guide members 22 consist of polytetrafluoroethylene belts or spring strip steel.

As FIG. 3 shows, the roller-like reversing element 13 is mounted on the side parts of the pivotable frame 11 via journals 29, whereas the roller 8 of the second belt conveyor 6 is mounted on roller journals 30. The reversing drum 3 is mounted by journals 28 on the side parts of the feeder frame 7. Deflection of the pivot lever 15 which is mounted on the side parts of the feeder frame 7 via pivot journals 17 is downwardly limited by an abutment 26 on the feeder frame side and is limited upwardly against the pretension of a spring 24 by an upper abutment 25.

The upper feeder table is adapted to be swung out of the rest position shown in FIG. 1 into the working position shown in FIG. 2 by a third belt conveyor 29 which is pivotable about the axis of the roller 5.

Figure 4:
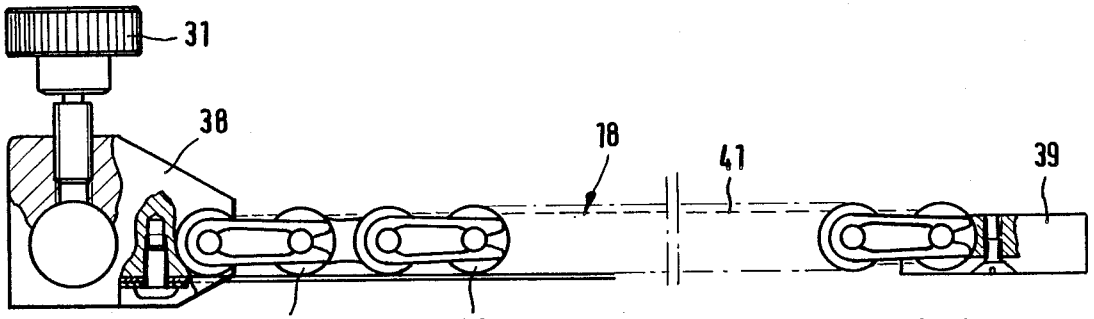
FIG. 4 shows a side view of the construction of a flexible guide means.
Figure 5:
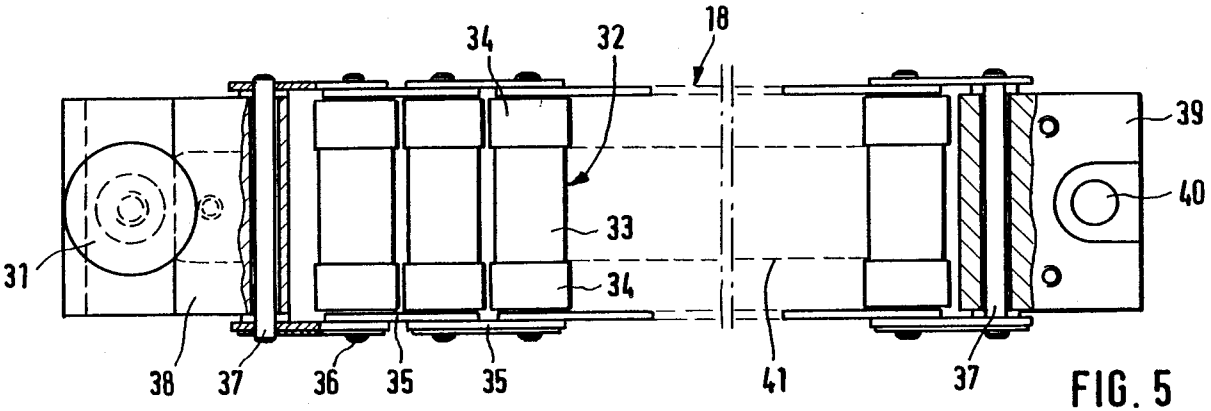
FIG. 5 shows the flexible guide means in FIG. 4, viewed from below.

The construction of the flexible guide means 18 is shown in details in FIGS. 4 and 5. The flexible guide means 18 has an upper mounting member 38 by which, using a clamping screw 31, it can be fixed on the upper rod 16 which connects the pivot levers 15. The upper mounting member 38 is articulatingly connected to the flexible guide means 18 via an end pin 37. At the bottom end, articulated on the flexible guide means 18 via a further end pin 37, there is a bottom mounting member 3 in which there is a bore 40 to which the spring 19 for attachment o the rod 20 (FIG. 1) can be fitted. The flexible guide means 18 consists of rollers 32 which are so connected in known manner by tie plates 35 and bolts 36 that the individual rollers 32 are rotatable and the positions of their axes in respect of one another can be varied according to the circumference of the reversing drum 3 or in order to adapt to the sheet stack height.

The rollers 32 consist of a low-friction synthetic plastics material and have in their central portion a recess 33 extending over the total periphery. Disposed in this recess, on the side associated with the reversing drum 3, there is a guide belt 41 shown by broken lines in FIGS. 4 and 5 and the thickness of which is less than the depth of the recesses 33. Thus, the gaps between the rollers 32 are covered in the region of the recesses 22 so that no portions of sheets can find their way into these gaps. There is no frictional contact between the guide belt 41 since the stack of sheets is only in contact with those guide portions 34 of the rollers 32 which are available laterally of the recesses 33.

Figure 6:
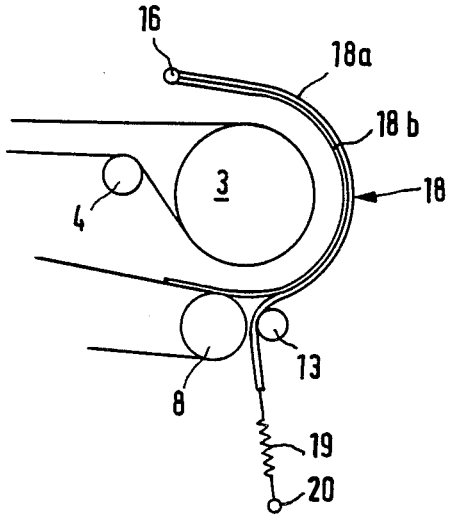
FIG. 6 is a view similar to that in FIG. 1 showing an alternative form of flexible guide means.

As flexible guide means 18, it is also possible to use belts of a low-friction synthetic plastics material such as polytetrafluoroethylene. In the case of the alternative embodiment shown in FIG. 6, each flexible guide means 18 consists of a belt comprising two layers **18*a* and 18*b*. The inner layer 18*b* which is towards the reversing drum 3 is not guided like the outer layer 18*a* around the reversing element 13 to the rod 20 but is applied as a transfer belt onto the second belt conveyor 6** on which it rests in the intake zone.

We claim:

1. A rotary sheet feeder comprising:

(a) a feeder frame;

(b) an upper feeder table mounted on said feeder frame for carrying imbricated stacks of sheets into the rotary sheet feeder, said upper feeder table comprising a first endless belt conveyor, a reversing drum mounted for rotation about a drum axis and at least one roller, said first endless belt conveyor being wound around said reversing drum and roller and having a delivery zone below said reversing drum;

(c) flexible guide means having an upper end and a lower end and being disposed about the periphery of said reversing drum for pressing said stacks of sheets against said first endless belt conveyor as it travels around said reversing drum;

(d) means for supporting the upper end of said flexible guide means above said upper feeder table;

(e) tensioning means attached to the lower end of said flexible guide means for tensioning said flexible guide means;

(f) a withdrawal table which is pivotably mounted on said feeder frame at a pivot axis which is parallel and spaced apart from said drum axis, said withdrawal table being disposed below said reversing drum for receiving imbricated stacks of sheets from said delivery zone and carrying them out of the delivery zone, said withdrawal table comprising at least two further rollers and a second endless belt conveyor wound around said further rollers, one of said further rollers being located adjacent said delivery zones;

(g) means for urging said withdrawal table upwardly towards said reversing drum; and (h) further support means mounted on said withdrawal table adjacent said delivery zone for supporting a portion of said flexible guide means intermediate said upper and lower ends, said portion of said flexible guide means curving away from said reversing drum around said further support means between said one further roller and said further support means.

2. A rotary sheet feeder as claimed in claim 1, wherein said flexible guide means are belts, which are composed of low-friction synthetic plastics material.

3. A rotary sheet feeder according to claim 2, wherein said flexible guide means are composed of polytetrafluoroethylene.

4. A rotary sheet feeder according to claim 2, wherein said flexible guide means further comprises one or more transfer belts whose lower ends rest on said second endless belt conveyor adjacent said delivery zone.

5. A rotary sheet feeder according to claim 1, wherein said flexible guide means comprises a plurality of guide rollers mounted on elongate flexible supports for rotation about parallel roller axes, said parallel roller axes being spaced apart along the length of said flexible supports and being parallel to said drum axis.

6. A rotary sheet feeder according to claim 5 wherein said guide rollers have mid-portions of smaller diameter than their end portions and an endless guide belts accommodated in said mid-portions between said end portions, said guide belt having a thickness which is less than the difference in said diameters of said mid and end portions.

7. A rotary sheet feeder according to claim 1 wherein said guide means comprises a plurality of flexible guide members spaced apart in the direction of said drum axis, said rotary sheet feeder further comprising lower guide members which extend between said flexible guide members immediately beneath said delivery zone, said lower guide members having free ends which rest on said second endless belt conveyor.

8. A rotary sheet feeder according to claim 7, further comprising upper guide members which extend downwardly between said flexible guide members and have free lower ends which rest on side lower guide members.

9. A rotary sheet feeder according to claim 7, wherein said lower guide members are in the form of belts composed of low-friction synthetic plastics material.

10. A rotary sheet feeder according to claim 8, wherein said upper guide members are in the form of belts composed of low friction synthetic plastics material.

11. A rotary sheet feeder as claimed in claim 1, wherein said means for supporting the upper end of said flexible guide means comprising an elongate member which is pivotally mounted on said feeder frame for rotation about a horizontal axis and which carried said flexible guide means at a region thereof which is spaced apart from said horizontal axis, pivoting of said elongate member being limited by upper and lower abutments and said elongate member being biased towards said lower abutment.

* * * * *

UNITED STATES PATENT AND TRADEMARK OFFICE

CERTIFICATE OF CORRECTION

PATENT NO. : 4,928,953

DATED : May 29, 1990

INVENTOR(S) : Karl-Fritz Heina et al.

It is certified that error appears in the above-identified patent and that said Letters Patent is hereby corrected as shown below:

In the drawing on the front page of the patent, gas spring 44 should be shown connected to frame 11 rather than to conveyor belt 6, as shown below:

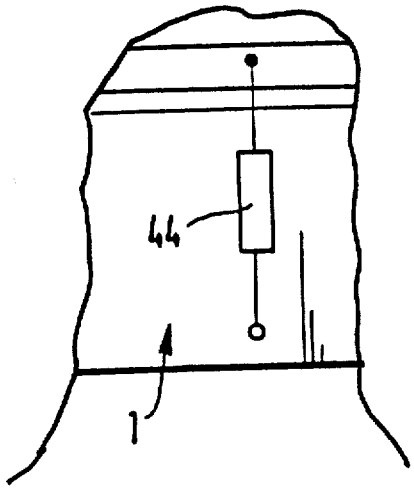

UNITED STATES PATENT AND TRADEMARK OFFICE

CERTIFICATE OF CORRECTION

PATENT NO. : 4,928,953

DATED : May 29, 1990

INVENTOR(S) : Karl-Fritz Heina et al.

It is certified that error appears in the above-identified patent and that said Letters Patent is hereby corrected as shown below: In the drawings, sheet 1, Figure 1, gas spring 44 should be shown connected to frame 11 rather than to conveyor belt 6, as shown below:

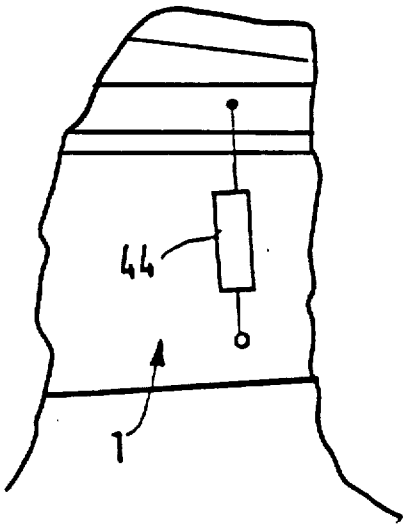

UNITED STATES PATENT AND TRADEMARK OFFICE

CERTIFICATE OF CORRECTION

PATENT NO. : 4,928,953

DATED : May 29, 1990

INVENTOR(S) : Karl-Fritz Heina et al.

It is certified that error appears in the above-identified patent and that said Letters Patent is hereby corrected as shown below: In the drawings, sheet 1, Fig. 2, gas spring 44 should be shown connected to frame 11 rather than to conveyor belt 6, as shown below:

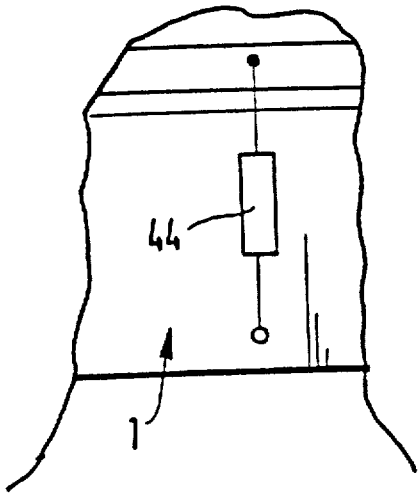

Signed and Sealed this

Nineteenth Day of November, 1991

*Attest:*

HARRY F. MANBECK, JR.

*Attesting Officer*

*Commissioner of Patents and Trademarks*